United States Patent [19]

Hellewell et al.

[11] Patent Number: 5,020,454

[45] Date of Patent: Jun. 4, 1991

[54] CLUSTERED CONCENTRIC TANGENTIAL FIRING SYSTEM

[75] Inventors: Todd D. Hellewell, North Granby; John Grusha, Windsor; Michael S. McCartney, Bloomfield, all of Conn.

[73] Assignee: Combustion Engineering, Inc., Windsor, Conn.

[21] Appl. No.: 606,682

[22] Filed: Oct. 31, 1990

[51] Int. Cl.[5] ..... F23D 1/02

[52] U.S. Cl. ..... 110/264; 110/297; 110/347; 431/173

[58] Field of Search ..... 110/263,.264, 265, 347, 110/297, 348; 431/173

[56] References Cited

U.S. PATENT DOCUMENTS

| | | | |
|---|---|---|---|
| 4,438,709 | 3/1984 | Borio et al. | 110/347 |
| 4,501,204 | 2/1985 | McCartney et al. | 110/264 |
| 4,655,148 | 4/1987 | Winship | 110/347 |
| 4,672,900 | 6/1987 | Santalla et al. | 110/264 |
| 4,722,287 | 2/1988 | Anderson et al. | 110/263 |

*Primary Examiner*—Edward G. Favors

*Attorney, Agent, or Firm*—Arthur E. Fournier, Jr.

[57] ABSTRACT

A clustered concentric tangential firing system (12) particularly suited for use in fossil fuel-fired furnaces (10) and a method of operating such furnaces (10) equipped with a clustered concentric tangential firing system (12). The clustered concentric tangential firing system (12) includes a windbox (20), a first cluster of fuel nozzles (38,40) mounted in the windbox (20) and operative for injecting clustered fuel into the furnace (10) so as to create a first fuel-rich zone therewithin, a second cluster of fuel nozzles (68,70) mounted in the windbox (20) and operative for injecting clustered fuel into the furnace (10) so as to create a second fuel-rich zone therewithin, an offset air nozzle (56) mounted in the windbox (20) and operative for injecting offset air into the furnace (10) such that the offset air is directed away from the clustered fuel injected into the furnace (10) and towards the walls of the furnace (10), a close coupled overfire air nozzle (78) mounted in the windbox (20) and operative for injecting close coupled overfire air into the furnace (10), and a separated overfire air nozzle (90) mounted in the window (20) and operative for injecting separated overfire air into the furnace (10).

19 Claims, 5 Drawing Sheets

CLUSTERED CONCENTRIC TANGENTIAL FIRING SYSTEM

CROSS-REFERENCE TO RELATED APPLICATION

This application is hereby cross-referenced to the following patent application which was commonly filed herewith and which is commonly assigned: U.S. Pat. application Ser. No. (C900010) filed 607,177, entitled "An Pulverized Overfire Air System For $NO_x$ Control", filed in the name of John L. Marion.

BACKGROUND OF THE INVENTION

This invention relates to tangentially fired, fossil fuel furnaces, and more specifically, to firing systems for reducing the $NO_x$ emissions from tangentially fired, pulverized coal furnaces.

Pulverized coal has been successfully burned in suspension in furnaces by tangential firing methods for a long time. The technique known as tangential firing involves introducing the fuel and air into a furnace from the four corners thereof so that the fuel and air are directed tangent to an imaginary circle in the center of the furnace. This type of firing has many advantages, among them being good mixing of the fuel and the air, stable flame conditions, and long residence time of the combustion gases in the furnaces.

Recently though, more and more emphasis has been placed on the minimization as much as possible of air pollution. To this end, most observers in the United States expect the U.S. Congress to enact comprehensive air emission reduction legislation by no later than the end of 1990. The major significance that such legislation will have is that it will be the first to mandate the retrofitting of $NO_x$ and $SO_x$ controls on existing fossil fuel fired units. Heretofore, prior laws have only dealt with the new construction of units.

With further reference in particular to the matter of $NO_x$ control, it is known that oxides of nitrogen are created during fossil fuel combustion by two separate mechanisms which have been identified to be thermal $NO_x$ and fuel $NO_x$. Thermal $NO_x$ results from the thermal fixation of molecular nitrogen and oxygen in the combustion air. The rate of formation of thermal $NO_x$ is extremely sensitive to local flame temperature and somewhat less so to local concentration of oxygen. Virtually all thermal $NO_x$ is formed at the region of the flame which is at the highest temperature. The thermal $NO_x$ concentration is subsequently "frozen" at the level prevailing in the high temperature region by the thermal quenching of the combustion gases. The flue gas thermal $NO_x$ concentrations are, therefore, between the equilibrium level characteristic of the peak flame temperature and the equilibrium level at the flue gas temperature.

On the other hand, fuel $NO_x$ derives from the oxidation of organically bound nitrogen in certain fossil fuels such as coal and heavy oil. The formation rate of fuel $NO_x$ is strongly affected by the rate of mixing of the fuel and air stream in general, and by the local oxygen concentration in particular. However, the flue gas $NO_x$ concentration due to fuel nitrogen is typically only a fraction, e.g., 20 to 60 percent, of the level which would result from complete oxidation of all nitrogen in the fuel. From the preceding it should thus now be readily apparent that overall $NO_x$ formation is a function both of local oxygen levels and of peak flame temperatures.

Continuing, some changes have been proposed to be made in the standard technique of tangential firing. These changes have been proposed primarily in the interest of achieving an even better reduction of emissions through the use thereof. One such change resulted in the arrangement that was the subject matter of U.S. Pat. application, Ser. No. 786,437, now abandoned, entitled "A Control System And Method For Operating A Tangentially Fired Pulverized Coal Furnace", which was filed on Oct. 11, 1985 and which was assigned to the same assignee as the present Pat. application. In accordance with the teachings of the aforesaid U.S. patent application, it was proposed to introduce pulverized coal and air tangentially into the furnace from a number of lower burner levels in one direction, and to introduce coal and air tangentially into the furnace from a number of upper burner levels in the opposite direction As a consequence of utilizing this type of arrangement, it was alleged that better mixing of the fuel and air was accomplished, thus permitting the use of less excess air than with a normal tangentially fired furnace, which, as is well-known to those skilled in this art, is generally fired with 20–30% excess air. The reduction in excess air helps minimize the formation of $NO_x$ which as noted previously herein is a major source of air pollution from coal-fired furnaces. The reduction in excess air also results in increased efficiency of the Furnace. Although the firing technique to which the aforesaid U.S. patent application was directed reduces $NO_x$ there were some disadvantages associated therewith. Namely, since the reverse rotation of the gases in the furnace cancel each other out, the gases flow in a more or less straight line through the upper portion of the furnace, thereby increasing the possibility of unburned carbon particles leaving the furnace due to reduced upper furnace turbulence and mixing. In addition, slag and unburned carbon deposits on the furnace walls can occur. These wall deposits reduce the efficiency of heat transfer to the water-cooled tubes lining the walls, increases the need for soot slowing, and reduces the life span of the tubes.

Another such change resulted in the arrangement that forms the subject matter of U.S. Pat. No. 4,715,301 entitled "Low Excess Air Tangential Firing System", which issued on Dec. 29, 1987 and which is assigned to the same assignee as the present patent application. In accordance with the teachings of U.S. Pat. No. 4,715,301, a furnace is provided in which pulverized coal is burned in suspension with good mixing of the coal and air, as in the case of the now abandoned U.S. patent application that has been the subject of discussion hereinabove. Furthermore, all of the advantages previously associated with tangentially fired furnaces are obtained, by having a swirling, rotating fireball in the Furnace. The walls are protected by a blanket of air, reducing slagging thereof. This is accomplished by introducing coal and primary air into the furnace tangentially at a first level, introducing auxiliary air in an amount at least twice that of the primary air into the furnace tangentially at a second level directly above the first level, but in a direction opposite to that of the primary air, with there being a plurality of such first and second levels, one above the other. As a result of the greater mass and velocity of the auxiliary air, the ultimate swirl within the furnace will be in the direction of the auxiliary air introduction. Because of this, the fuel, which is introduced in a direction counter to the swirl of the furnace, is forced after entering the unit to change direction to that of the overall furnace gases. Tremendous turbulent mixing between the fuel and air is thus created in this process. This increased mixing reduces the need for high levels of excess air within the furnace. This increased mixing also results in enhanced carbon conversion which improves the furnace's overall heat release rate while at the same time reducing upper furnace slagging and fouling. The auxiliary air is directed at a circle of larger diameter than that of the fuel, thus forming a layer of air adjacent the walls. In addition, overfire air, consisting essentially of all of the excess air supplied to the furnace, is introduced into the furnace at a level considerably above all of the primary and auxiliary air introduction levels, with the overfire air being directed tangentially to an imaginary circle, and in a direction opposite to that of the auxiliary air.

Yet another such change resulted in the arrangement for firing pulverized coal as a fuel with low $NO_x$ emissions that forms the subject matter of U.S. Pat. No. 4,669,398, entitled "Pulverized Fuel Firing Apparatus", and which issued on June 2, 1987. In accordance with the teachings of U.S. Pat. No. 4,669,398, an apparatus is provided which is characterized by a first pulverized fuel injection compartment in which the combined amount of primary air and secondary air to be consumed is less than the theoretical amount of air required for the combustion of the pulverized fuel to be fed as mixed with the primary air to a furnace, by a second pulverized fuel injection compartment in which the combined primary and secondary air amount is substantially equal to, or, preferably, somewhat less than, the theoretical air for the fuel to be fed as mixed with the primary air, and by a supplementary air compartment for injecting supplementary air into the furnace, the three compartments being arranged close to one another. The gaseous mixtures of primary air and pulverized fuel injected by the first and second pulverized fuel injection compartments of the apparatus are mixed in such proportions as to reduce the $NO_x$ production. Moreover, the primary air-pulverized fuel mixture from the second pulverized fuel injection compartment, which alone can hardly be ignited stably, is allowed to coexist with the flame of the readily ignitable mixture from the first pulverized fuel injection compartment to ensure adequate ignition and combustion. An apparatus is thus allegedly provided for firing pulverized fuel with stable ignition and low $NO_x$ production.

Secondly, the apparatus in accordance with the teachings of U.S. Pat. No. 4,669,398 is characterized in that additional compartments for issuing an inert fluid are disposed, one for each, in spaces provided between the three compartments. The gaseous mixtures of primary air and pulverized fuel are thus kept from interfering with each other by a curtain of the inert fluid from one of the inert fluid injection compartments, and the production of $NO_x$ from the gaseous mixtures that are discharged from the first and second pulverized fuel injection compartments allegedly can be minimized. Also, the primary air-pulverized fuel mixture from the first pulverized fuel injection compartment and the supplementary air from the supplementary air compartment are prevented from interfering with each other by another curtain of the inert fluid from another compartment. This allegedly permits the primary air-pulverized fuel mixture to burn without any change in the mixing ratio, thus avoiding any increase in the $NO_x$ production.

Yet still another change resulted in the arrangement for firing pulverized coal as a fuel while at the same time effecting a reduction in $NO_x$ and $SO_x$ emission that forms the subject matter of U. U.S. Pat No. 4,426,939, entitled "Method Of Reducing $NO_x$ and SO Emission", which issued on Jan. 24, 1984 and which is assigned to the same assignee as the present patent application. In accordance with the teachings of U.S. Pat. No. 4,426,939, a furnace is fired with pulverized coal in a manner that reduces the peak temperature in the furnace while still maintaining good flame stability and complete combustion of the fuel. The manner in which this is accomplished is as follows. Pulverized coal is conveyed in an air stream towards the furnace. In the course of being so conveyed, the stream is separated into two portions, with one portion being a fuel rich portion and the other portion being a fuel lean portion. The fuel rich portion is introduced into the furnace in a first zone. Air is also introduced into the first zone in a quantity insufficient to support complete combustion of all of the fuel in the fuel rich portion. The fuel lean portion, on the other hand, is introduced into the furnace in a second zone. Also, air is introduced into the second zone in a quantity such that there is excess air over that required for combustion of all of the fuel within the furnace. Lastly, lime is introduced into the furnace simultaneously with the fuel so as to minimize the peak temperature within the furnace thereby to also minimize the formation of $NO_x$ and $SO_x$ in the combustion gases.

Although firing systems constructed in accordance with the teachings of the now abandoned U.S. patent application and the three issued U.S. patents to which reference has been made heretofore have been demonstrated to be operative for the purpose for which they have been designed, there has nevertheless been evidenced in the prior art a need for such firing systems to be further improved if through the use thereof $NO_x$ emissions are to be reduced to the levels which would be required to be met under the proposed new legislation being contemplated by the U.S. Congress. A need is thus being evidenced in the prior art for a new and improved firing system that would be applicable, in particular, for use in tangentially fired, pulverized coal furnaces to achieve $NO_x$ emission reductions of as much as 50% to 60% from that which would otherwise be emitted from such furnaces which are equipped with prior art forms of firing systems. Moreover, there has been evidenced in the prior art a need for such a new and improved firing system that would be particularly characterized in a number of respects. To this end, one such characteristic which such a new and improved firing system would desirably possess is the capability of establishing through the use thereof several layers of fuel-rich zones in the furnace burner area. Such an arrangement facilitates immediate ignition and associated high temperature with the concomitant effect that release of the organically-bound nitrogen from the coal is introduced into the large fuel-rich zones. Another characteristic which such a new and improved firing system would desirably possess is the ability to achieve through the use thereof both stabilization of the fuel front and the initial devolatilization within the fuel-rich zones of the fuel-bound nitrogen whereby the fuel-bound nitrogen is converted in the fuel-rich zones to $N_2$. A third characteristic which such a new and improved firing system would desirably possess is the capability of providing through the use thereof "boundary air" to protect the furnace walls from the reducing atmospheres that are known to exist within the furnace when the furnace is in operation. A fourth characteristic which such a new and improved firing system would desirably possess is the capability of providing through the use thereof sufficient overfire air to permit the completion of efficient combustion of the fuel rich furnace gases before these gases reach the convective pass of the furnace. The objective, which is sought to be realized in this regard, is that of ensuring both that the coal combustion process is completed and that the amount of unburned carbon is minimized.

To thus summarize, a need has been evidenced in the prior art for such a new and improved firing system that would be particularly suited for use in connection with tangentially fired, fossil fuel furnaces and that when so employed therein would render it possible to accomplish through the use thereof reductions in the level of $NO_x$ emissions to levels that are at least equivalent to if not better than that which is currently being contemplated as the standard for the U.S. in the legislation which is being proposed. Moreover, such results would be achievable with such a new and improved firing system without the necessity of requiring for the operation thereof any additions, catalysts or added premium fuel costs. In addition, such results would be achievable with such a new and improved firing system that incorporates provisions for eliminating waterwall corrosion which is commonly associated with the reducing atmosphere that is produced during deep staged combustion operation. Furthermore, such results would be attainable with such a new and improved firing system which is totally compatible with other emission reduction-type systems such as limestone injection systems, reburn systems and selective catalytic reduction (SCR) systems that one might seek to employ in order to accomplish even additional emission reduction. Last but not least, such results would be attainable with such a new and improved firing system which is equally suitable for use either in new applications or in retrofit applications.

It is, therefore, an object of the present invention to provide a new and improve $NO_x$ emission reducing firing system for use in fossil fuel-fired furnaces.

It is a further object of the present invention to provide such a $NO_x$ emission reducing firing system for furnaces that is particularly suited for use in tangentially-fired, pulverized coal furnaces.

It is another object of the present invention to provide such a $NO_x$ emission reducing firing system for furnaces which is characterized in that through the use thereof $NO_x$ emissions are capable of being reduced to levels that are at least equivalent to if not better than that which is currently being contemplated as the standard for the U.S. in the legislation being proposed.

It is still another object of the present invention to provide such a $NO_x$ emission reducing firing system for furnaces which is characterized in that through the use thereof $NO_x$ emission reductions are capable of being achieved of as much as 50% to 60% from that which would otherwise be emitted from furnaces which are equipped with prior art forms of firing systems.

Another object of the present invention is to provide such a $NO_x$ emission reducing firing system for furnaces which is characterized in that through the use thereof several layers of fuel-rich zones are established in the furnace burner area.

A still another object of the present invention is to provide such a $NO_x$ emission reducing firing system for furnaces which is characterized in that through the use thereof immediate ignition and associated high temperature are facilitated with the concomitant effect that release of the originally-bound nitrogen from the pulverized coal being fired in the furnace is introduced into the large fuel-rich zones.

A further object of the present invention is to provide such a $NO_x$ emission reducing firing system for furnaces which is characterized in that through the use thereof there is accomplished stabilization of the flame front as well as the initial devolatilization within the fuel-rich zones of the fuel-bound nitrogen whereby the fuel-bound nitrogen is converted to $N_2$ in the fuel-rich zones.

A still further object of the present invention is to provide such a $NO_x$ emission reducing firing system for furnaces which is characterized in that through the use thereof sufficient overfire air is provided to permit the completion of efficient combustion of the fuel rich furnace gases before these gases reach the convective pass of the furnace.

Yet an object of the present invention is to provide such a $NO_x$ emission reducing firing system for furnaces which is characterized in that through the use thereof no additions, catalysts or added premium fuel costs are needed for the operation thereof.

Yet a further object of the present invention is to provide such a $NO_x$ emission reducing firing system for furnaces which is characterized in that provisions are incorporated therein for eliminating waterwall corrosion which is produced during deep staged combustion operation.

Yet another object of the present invention is to provide such a $NO_x$ emission reducing firing system for furnaces which is characterized in that it is totally compatible with other emission reducing-type systems such as limestone injection systems, reburn systems and selective catalytic reduction (SCR) systems that one might seek to employ in order to accomplish additional emission reduction.

Yet still another object of the present invention is to provide such a $NO_x$ emission reducing firing system for furnaces which is characterized in that it is equally well suited for use either in new applications or in retrofit applications.

SUMMARY OF THE INVENTION

In accordance with one aspect of the present invention there is provided a clustered concentric tangential firing system that is particularly suited for use in fossil fuel-fired furnaces embodying a burner region. The subject clustered concentric tangential firing system includes a housing preferably in the form of a windbox, which is suitably supported in the burner region of the furnace, so that the longitudinal axis of the windbox extends substantially in parallel relation to the longitudinal axis of the furnace. A first air compartment is provided at the lower end of the windbox. An air nozzle is supported in mounted relation within the first air compartment. An air supply means is operatively connected to the air nozzle for supplying air thereto and therethrough into the burner region of the furnace. A first pair of fuel compartments is provided in the windbox within the lower portion thereof such as to be located substantially in juxtaposed relation to the first air compartment. A first cluster of fuel nozzles is supported in mounted relation within the first pair of fuel compartments. A fuel supply means is operatively connected to the first cluster of fuel nozzles for supplying fuel thereto and therethrough into the burner region of the furnace thereby so as to create a fuel-rich zone therewithin. A plurality of offset air compartments are provided in the windbox such as to be located substantially in juxtaposed relation to the first pair of fuel compartments. An offset air nozzle is supported in mounted relation within each of the plurality of offset air compartments. A second pair of fuel compartments is provided in the windbox such as to be located substantially in juxtaposed relation to the plurality of offset air compartments. A second cluster of fuel nozzles is supported in mounted relation within the second pair of fuel compartments. A fuel supply means is operatively connected to the second cluster of fuel nozzles for supplying fuel thereto and therethrough into the burner region of the furnace thereby so as to create a fuel-rich zone therewithin. At least one close coupled overfire air compartment is provided at the upper end of the windbox such as to be located substantially in juxtaposed relation to the second pair of fuel compartments. A close coupled overfire air nozzle is supported in mounted relation within the close coupled overfire air compartment. An overfire air supply means is operatively connected to the close coupled overfire air nozzle for supplying overfire air thereto and therethrough into the burner region of the furnace. A plurality of separated overfire air compartments are suitably supported within the burner region of the furnace so as to be spaced from at least one close coupled overfire air compartment and so as to be substantially aligned with the longitudinal axis of the windbox. A separated overfire air nozzle is supported in mounted relation within each of the plurality of separated overfire air compartments. An overfire air supply means is operatively connected to the separated overfire air nozzles for supplying overfire air thereto and therethrough into the burner region of the furnace.

In accordance with another aspect of the present invention there is provided a method of operating a firing system of the type that is particularly suited for use in fossil-fuel fired furnaces embodying a burner region. The subject method of operating a firing system includes the steps of introducing air into the burner region of the furnace at a first level thereof, introducing clustered fuel into the burner region of the furnace at a second level thereof so as to create a first fuel-rich zone within the burner region of the furnace, introducing offset air into the burner region of the furnace at a third level thereof such that the offset air is directed away from the clustered fuel previously injected into the burner region of the furnace and towards the walls of the furnace, introducing additional clustered fuel into the burner region of the furnace at a fourth level thereof so as to create a second fuel-rich zone within the burner region of the furnace, introducing close coupled overfire air into the burner region of the furnace at a fifth level thereof, and introducing separated overfire air into the burner region of the furnace at a sixth level thereof that is spaced from but aligned with the fifth level of the burner region of the furnace.

DESCRIPTION OF THE PREFERRED EMBODIMENT

Figure 1:
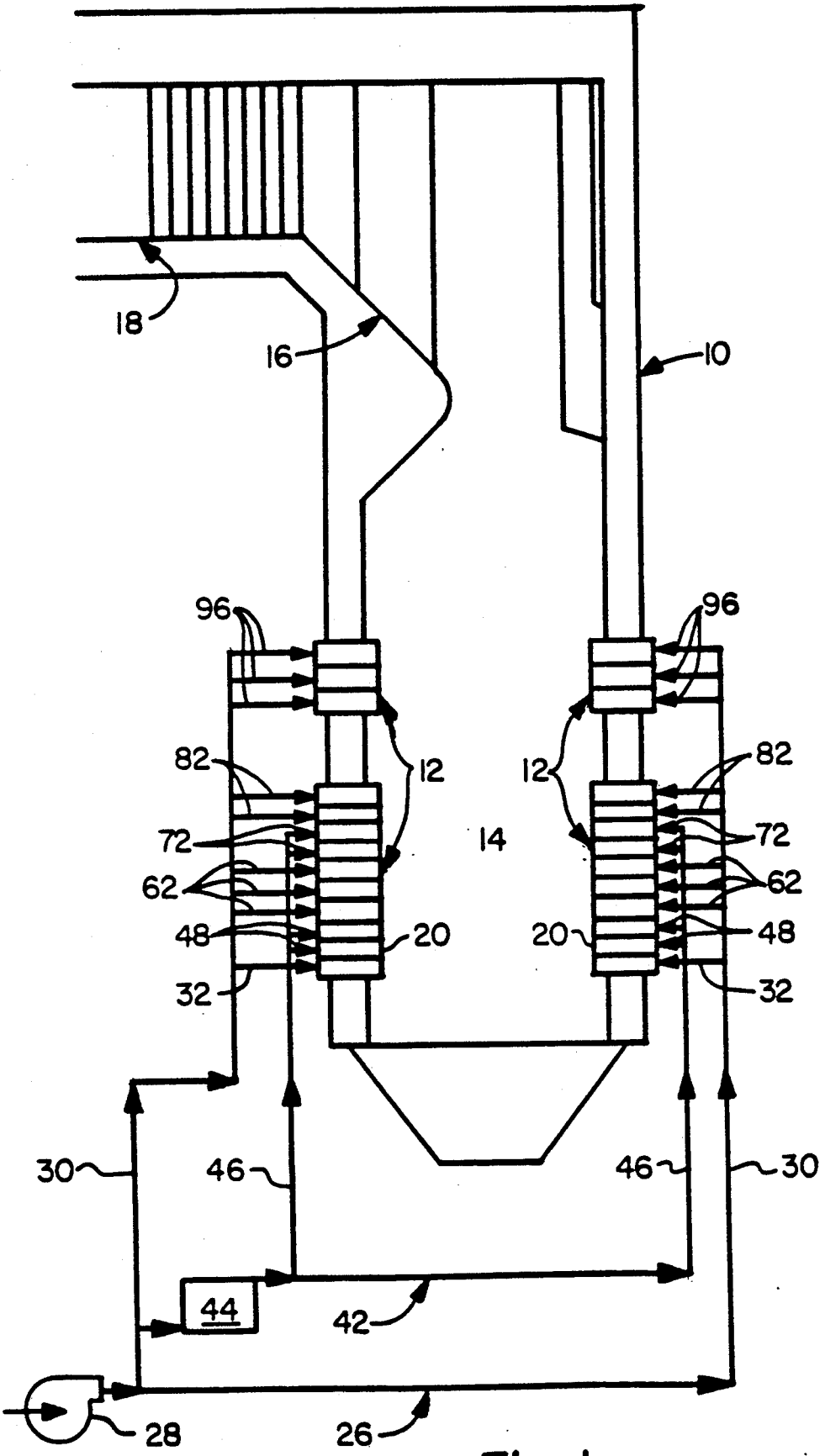
FIG. 1 is a diagrammatic representation in the nature of a vertical sectional view of a fossil fuel-fired furnace embodying a clustered concentric tangential firing system constructed in accordance with the present invention.

Referring now to the drawing, and more particularly to FIG. thereof, there is depicted therein a fossil fuel-fired furnace, generally designated by reference numeral 10. Inasmuch as the nature of the construction and the mode of operation of fossil fuel-fired furnaces per se are well-known to those skilled in the art, it is not deemed necessary, therefore, to set forth herein a detailed description of the fossil fuel-fired furnace 10 illustrated in FIG. 1. Rather, for purposes of obtaining an understanding of a fossil fuel-fired furnace 10, which is capable of having cooperatively associated therewith a clustered concentric tangential firing system, generally designated by the reference numeral 12 in FIG. 1 of the drawing, that in accordance with the present invention is capable of being installed therein and when so installed therein the clustered concentric tangential firing system is operative for reducing the $NO_x$ emissions from the fossil fuel-fired furnace 10, it is deemed to be sufficient that there be presented herein merely a description of the nature of the components of the fossil fuel-fired furnace 10 with which the aforesaid clustered concentric tangential firing system 12 cooperates. For a more detailed description of the nature of the construction and the mode of operation of the components of the fossil fuel-fired furnace 10, which are not described herein, one may have reference to the prior art, e.g., U.S. Pat. No. 4,719,587, which issued Jan. 12, 1988 to F. J. Berte.

Referring further to FIG. 1 of the drawing, the fossil fuel-fired furnace 10 as illustrated therein includes a burner region, generally designated by the reference numeral 14. As will be described more fully hereinafter in connection with the description of the nature of the construction and the mode of operation of the clustered concentric tangential firing system 12, it is within the burner region 14 of the fossil fuel-fired furnace 10 that in a manner well-known to those skilled in this art combustion of the fossil fuel and air is initiated. The hot gases that are produced from combustion of the fossil fuel and air rise upwardly in the fossil fuel-fired furnace 10. During the upwardly movement thereof in the fossil fuel-fired furnace 10, the hot gases in a manner well-known to those skilled in this art give up heat to the fluid passing through the tubes (not shown in the interest of maintaining clarity of illustration in the drawing) that in conventional fashion line all four of the walls of the fossil fuel-fired furnace 10. Then, the hot gases exit the fossil fuel-fired furnace 10 through the horizontal pass, generally designated by the reference numeral 16, of the fossil fuel-fired furnace 10, which in turn leads to the rear gas pass, generally designated by the reference numeral 18, of the fossil fuel-fired furnace 10. Both the horizontal pass 16 and the rear gas pass 18 commonly contain other heat exchanger surface (not shown) for generating and super heating steam, in a manner well-known to those skilled in this art. Thereafter, the steam commonly is made to flow to a turbine (not shown), which forms one component of a turbine/generator set (not shown), such that the steam provides the motive power to drive the turbine (not shown) and thereby also the generator (not shown), which in known fashion is cooperatively associated with the turbine, such that electricity is thus produced from the generator (not shown).

Figure 2:
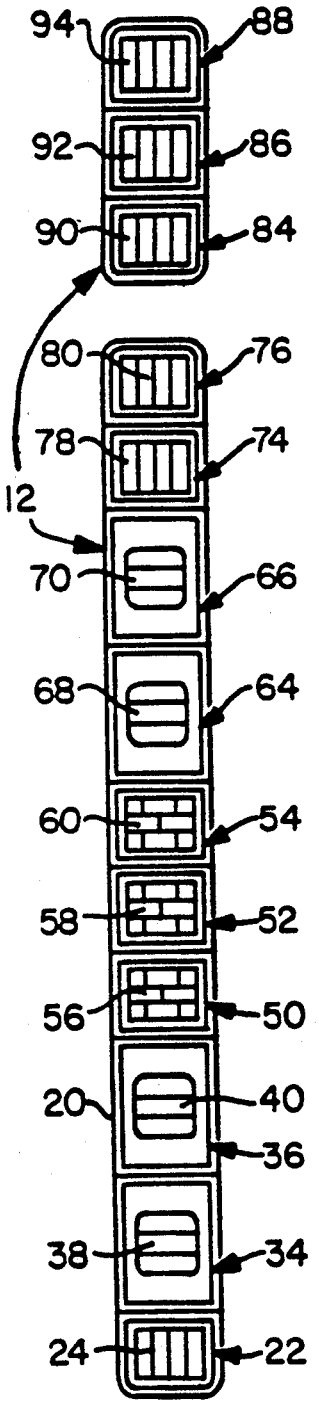
FIG. 2 is a diagrammatic representation in the nature of a vertical sectional view of an embodiment of a clustered concentric tangential firing system, which is particularly suited for use in coal firing applications, constructed in accordance with the present invention.

With the preceding by way of background, reference will now be had particularly to FIGS. 1 and 2 of the drawing for purposes of describing the clustered concentric tangential firing system 12 which in accordance with the present invention is designed to be cooperatively associated with a furnace constructed in the manner of the fossil fuel-fired furnace 10 that is depicted in FIG. 1 of the drawing. More specifically, the clustered concentric tangential firing system 12 is designed to be utilized in a furnace such as the fossil fuel-fired furnace 10 of FIG. 1 of the drawing so that when so utilized therewith the clustered concentric tangential firing system 12 is operative to reduce the $NO_x$ emissions from the fossil fuel-fired furnace 10.

As best understood with reference to FIGS. 1 and 2 of the drawing, the clustered concentric tangential firing system 12 includes a housing preferably in the form of a windbox denoted by the reference numeral 20 in FIGS. 1 and 2 of the drawing. The windbox 20 in a manner well-known to those skilled in this art is supported by conventional support means (not shown) in the burner region 14 of the fossil fuel-fired furnace 10 such that the longitudinal axis of the windbox 20 extends substantially in parallel relation to the longitudinal axis of the fossil fuel-fired furnace 10.

Continuing with the description of the clustered concentric tangential firing system 12, in accord with the preferred embodiment of the invention a first air compartment, denoted generally by the reference numeral 22 in FIG. 2 of the drawing, is provided at the lower end of the windbox 20. An air nozzle 24 is supported in mounted relation, through the use of any conventional form of mounting means (not shown) suitable for use for such a purpose, within the air compartment 22. An air supply means, which is illustrated schematically in FIG. 1 of the drawing wherein the air supply means is denoted generally by the reference numeral 26, is operatively connected in a manner to be more fully described hereinafter to the air nozzle 24 whereby the air supply means 26 supplies air to the air nozzle 24 and therethrough into the burner region 14 of the fossil fuel-fired furnace 10. To this end, the air supply means 26 includes a fan seen at 28 in FIG. 1 of the drawing, and the air ducts denoted by the reference numeral 30 which are connected in fluid flow relation to the fan 28 on the one hand and on the other hand as seen schematically at 32 in FIG. 1 of the drawing to the air nozzle 24 through separate valves and controls (not shown).

With further reference to the windbox 20, in accord with the preferred embodiment of the invention a first pair of fuel compartments, denoted generally by the reference numerals 34 and 36, respectively, in FIG. 2 of the drawing, is provided in the windbox 20 within the lower portion thereof such as to be located substantially in juxtaposed relation to the air compartment 22. A first cluster of fuel nozzles, denoted by the reference numerals 38 and 40, respectively, in FIG. 2 of the drawing, is supported in mounted relation, through the use of any conventional form of mounting means (not shown) suitable for use for such a purpose, within the pair of fuel compartments 34 and 36 such that the fuel nozzle 38 is mounted in the fuel compartment 34 and the fuel nozzle 40 is mounted in the fuel compartment 36. A fuel supply means, which is illustrated schematically in FIG. 1 of the drawing wherein the fuel supply means is denoted generally by the reference numeral 42, is operatively connected in a manner to be more fully described hereinafter to the fuel nozzles 38 and 40 whereby the fuel supply means 42 supplies fuel to the fuel nozzles 38 and 40 and therethrough into the burner region 14 of the fossil fuel-fired furnace 10. Namely, the fuel supply means 42 includes a pulverizer, seen at 44 in FIG. 1 of the drawing, wherein the fossil fuel that is to be burned in the fossil fuel-fired furnace 10 undergoes pulverization in a manner well-known to those skilled in this art, and the fuel ducts, denoted by the reference numeral 46, which are connected in fluid flow relation to the pulverizer 44 on the one hand and on the other hand as seen schematically at 48 in FIG. 1 of the drawing to the cluster of fuel nozzles 38 and 40 through separate valves and controls (not shown). As can be seen with reference to FIG. 1 of the drawing, the pulverizer 44 is operatively connected to the fan 28 such that air is also supplied from the fan 28 to the pulverizer 44 whereby the fuel supplied from the pulverizer 44 to the cluster of fuel nozzles 38 and 40 is transported through the fuel ducts 46 in an air stream in a manner which is well-known to those skilled in this art.

In addition to the air compartment 22 and the pair of fuel compartments 34 and 36 which have been described hereinabove, the windbox 20 is also provided with a plurality of offset air compartments. The aforementioned plurality of offset air compartments, in accordance with the preferred embodiment of the invention, comprises in number preferably three such compartments which are denoted generally by the reference numerals 50, 52 and 54 in FIG. 2 of the drawing. As best understood with reference to FIG. 2 of the drawing, the offset air compartments 50, 52 and 54 are provided in the windbox 20 such as to be located substantially in juxtaposed relation to the pair of fuel compartments 34 and 36. An offset air nozzle, denoted by the reference numerals 56, 58 and 60, respectively, in FIG. 2 of the drawing, is supported in mounted relation, through the use of any conventional form of mounting means (not shown) suitable for use for such a purpose, within the plurality of offset air compartments 50, 52 and 54 such that the offset air nozzle 56 is mounted in offset air compartment 50, the offset air nozzle 58 in offset air compartment 52, and the offset air nozzle 60 in offset air compartment 54, and such that the offset air which passes through each of the offset air nozzles 56, 58 and 60 is directed away from the clustered fuel that is injected into the burner region 14 of the furnace 10 and towards the walls of the furnace 10. The offset air nozzles 56, 58 and 60 are each operatively connected to the air supply means 26, the latter having been described previously herein, through the air ducts 30, which as best understood with reference to FIG. 1 of the drawing are connected in fluid flow relation to the fan 28 on the one hand and on the other hand as seen schematically at 62 in FIG. 1 of the drawing to each of the offset air nozzles 56, 58 and 60 through separate valves and controls (not shown) whereby the air supply means 26 supplies air to each of the offset air nozzles 56, 58 and 60 and therethrough into the burner region 14 of the fossil fuel-fired furnace 10 in the manner which has been described herein previously.

Continuing with the description of the clustered concentric tangential system 12, in accord with the preferred embodiment of the invention a second pair of fuel compartments, denoted generally by the reference numerals 64 and 66, respectively, in FIG. 2 of the drawing, is provided in the windbox 20 such as to be located substantially in juxtaposed relation to the plurality of offset air compartments 50, 52 and 54. A second cluster of fuel nozzles, denoted by the reference numerals 68 and 70 respectively in FIG. 2 of the drawing, is supported in mounted relation, through the use of any Conventional form of mounting means (not shown) suitable for use for such a purpose, within the pair of fuel compartments 64 and 66 such that the fuel nozzle 68 is mounted in the fuel compartment 64 and the fuel nozzle 70 is mounted in the fuel compartment 66. The second cluster of fuel nozzles 68 and 70 are each operatively connected to the fuel supply means 42, the latter having been described previously herein, through the fuel ducts 46, which as best understood with reference to FIG. 1 of the drawing are connected in fluid flow relation on the one hand to the pulverizer 44 wherein the fossil fuel-fired furnace 10 undergoes pulverization in a manner well-known to those skilled in this art, and on the other hand as seen schematically at 72 in FIG. 1 of the drawing to the cluster of fuel nozzles 68 and 70 through separate valves and controls (not shown). Mention is once again made here to the fact that as can be seen with reference to FIG. 1 of the drawing, the pulverizer 44 is operatively connected to the fan 28 such that air is also supplied from the fan 28 to the pulverizer 44 whereby the fuel supplied from the pulverizer 44 to the cluster of fuel nozzles 68 and 70 is transported through the fuel ducts 46 in an air stream in a manner which is well-known to those skilled in the art.

With further reference to the windbox 20, in accord with the preferred embodiment of the invention a pair of close coupled overfire air compartments, denoted generally by the reference numerals 74 and 76, respectively, in FIG. 2 of the drawing, is provided in the windbox 20 within the upper portion thereof such as to be located substantially in juxtaposed relation to the second pair of fuel compartments 64 and 66. A pair of close coupled overfire air nozzles, denoted by the reference numerals 78 and 80, respectively, in FIG. 2 of the drawing, is supported in mounted relation, through the use of any conventional form of mounting means (not shown) suitable for use for such a purpose, within the pair of close coupled overfire air compartments 74 and 76 such that the close coupled overfire air nozzle 78 is mounted in the close coupled overfire air compartment 74 and the close coupled overfire air nozzle 80 is mounted in the close coupled overfire air compartment 76. The close coupled overfire air nozzles 78 and 80 are each operatively connected to the air supply means 26, the latter having been described previously herein, through the air ducts 30, which as best understood with reference to FIG. 1 of the drawing are connected in fluid flow relation to the fan 28 on the one hand and on the other hand as seen schematically at 82 in FIG. 1 of the drawing to each of the close coupled offset air nozzles 78 and 80 through separate valves and controls (not shown) whereby the air supply means 26 supplies air to each of the close coupled offset air nozzles 78 and 80 and therethrough into the burner region 14 of the fossil fuel-fired furnace 10.

Completing the description of the clustered concentric tangential firing system 12, a plurality of separated overfire air compartments are suitably supported, through the use of any conventional form of support means (not shown) suitable for use for such a purpose, within the burner region 14 of the furnace 10 so as to be spaced from the close coupled overfire air compartments 74 and 76, and so as to be substantially aligned with the longitudinal axis of the windbox 20. The aforementioned plurality of separated overfire air compartments, in accordance with the preferred embodiment of the invention, comprises in number preferably three such compartments, which are denoted generally in FIG. 2 of the drawing by the reference numerals 84, 86 and 88, respectively. A plurality of separated overfire air nozzles, denoted by the reference numerals 90, 92 and 94, respectively, in FIG. 2 of the drawing, are supported in mounted relation, through the use of any conventional form of mounting means (not shown) suitable for use for such a purpose, within the plurality of separated overfire air compartments 84, 86 and 88 such that the separated overfire air nozzle 90 is mounted in the separated overfire air compartment 84, the separated overfire air nozzle 92 is mounted in the separated overfire air compartment 86, and the separated overfire air nozzle 94 is mounted in the separated overfire air compartment 88. The plurality of separated overfire air nozzles 90, 92 and 94 are each operatively connected to the air supply means 26, the latter having been described previously herein, through the air ducts 30, which as best understood with reference to FIG. 1 of the drawing are connected in fluid flow relation to the fan 28 on the one hand and on the other hand as seen schematically at 96 in FIG. 1 of the drawing to each of the separated overfire air nozzles 90, 92 and 94 through separate valves and controls (not shown) whereby the air supply means 26 supplies air to each of the separated overfire air nozzles 90, 92 and 94 and therethrough into the burner region 14 of the fossil fuel-fire furnace 10.

A brief description will now be set forth herein of the mode of operation of the clustered concentric tangential firing system 12 constructed in accordance with the present invention, which is designed to be employed in a tangentially fired, fossil fuel furnace for the purpose of reducing the $NO_x$ emissions from such a furnace. To this end, in accordance with the mode of operation of the clustered concentric tangential firing system 12 air is introduced through the air compartment 24 into the burner region 14 of the furnace 10 at a first level thereof. Clustered fuel is introduced through a first cluster of fuel nozzles 38 and 40 into the burner region 14 of the furnace 10 at a second level thereof so as to create a first fuel-rich zone within the burner region 14 of the furnace 10. Offset air is introduced through the plurality of offset air is introduced through the plurality of offset air nozzles 56, 58 and 60 into the burner region 14 of the furnace 10 at a third level thereof such that the offset air introduced through the plurality of offset air nozzles 56, 58 and 60 is directed away from the clustered fuel injected into the burner region 14 of the furnace 10 and towards the walls of the furnace 10. Additional clustered fuel is introduced through a second cluster of fuel nozzles 68 and 70 into the burner region 14 of the furnace 10 at a fourth level thereof so as to create a second fuel-rich zone within the burner region 14 of the furnace 10. Close coupled overfire air is introduced through the close coupled overfire air nozzles 78 and 80 into the burner region 14 of the furnace 10 at a fifth level thereof. Lastly, separated overfire air is introduced through the separated overfire air nozzles 90, 92 and 94 into the burner region 14 of the furnace 10 at a sixth line thereof that is spaced from but aligned with the fifth level of the burner region 14 of the furnace 10.

Thus, by way of a summary, the clustered concentric tangential firing system 12 which forms the subject matter of the present invention is deemed to have advanced the state-of-the-art in $NO_x$ emissions control. To this end, the clustered concentric tangential firing system 12 of the present invention is designed to control the availability of oxygen to the fuel throughout the combustion process. Namely, the clustered concentric tangential firing system 12 is a deeply staged combustion technique that employs multiple elevations of overfire air to minimize the available $O_2$ in the primary combustion zone. Overfire air is introduced at the top of the windbox 20 of the fuel admission assemblies as close coupled overfire air 74,76 and at a higher elevation as separated overfire air B4,86,88. Two levels of overfire air introduction, i.e., 74,76 and 84,86,BB, permit the height of the windbox 20 to remain the same as earlier prior art forms of windboxes, thus retrofitting the clustered concentric tangential firing system 12 to an existing furnace is enhanced.

The clustered concentric tangential firing system 12 constructed in accord with the present invention is further characterized by the fact that the clustered concentric tangential firing system 12 utilizes the concentric firing principle of directing the auxiliary air away from the fuel toward the waterwalls of the furnace 10. This serves to protect the waterwalls of the furnace 10 from the reducing atmosphere inherent in bulk furnace combustion staging by overfire air. Concentric firing also serves to control furnace outlet temperature which would otherwise rise due to staged combustion. Lastly, the clustered concentric tangential firing system 12 incorporates a new concept of clustered fuel nozzles 38,40 and 68,70 which maximize the separation of the fuel and air in the early stages of combustion. The combination of the features enumerated above allows the clustered concentric tangential firing system 12 to achieve very low $NO_x$ emissions with minimal impact on the normal operation of the furnace 10.

In conclusion, the concept upon which the clustered concentric tangential firing system 12 of the present invention is based is premised on the fact that both overfire air staging and final furnace $O_2$ content dominate in controlling the final $NO_x$ levels of emissions from a furnace. Research data generated by the assignee of the present application shows that between primary stage stoichiometries of 0.5 and 0.85 $NO_x$ production is minimized, but that $NO_x$ production will increase both above and below that window of stoichiometry. Thus, the goal of the test program that culminated in the development of the clustered concentric tangential firing system 12 which forms the subject matter of the present invention was to develop a deeply staged tangential firing system within the confines of the windbox of an existing tangentially fired, fossil-fueled furnace, thus enhancing the retrofitability of the firing system.

Figure 6:
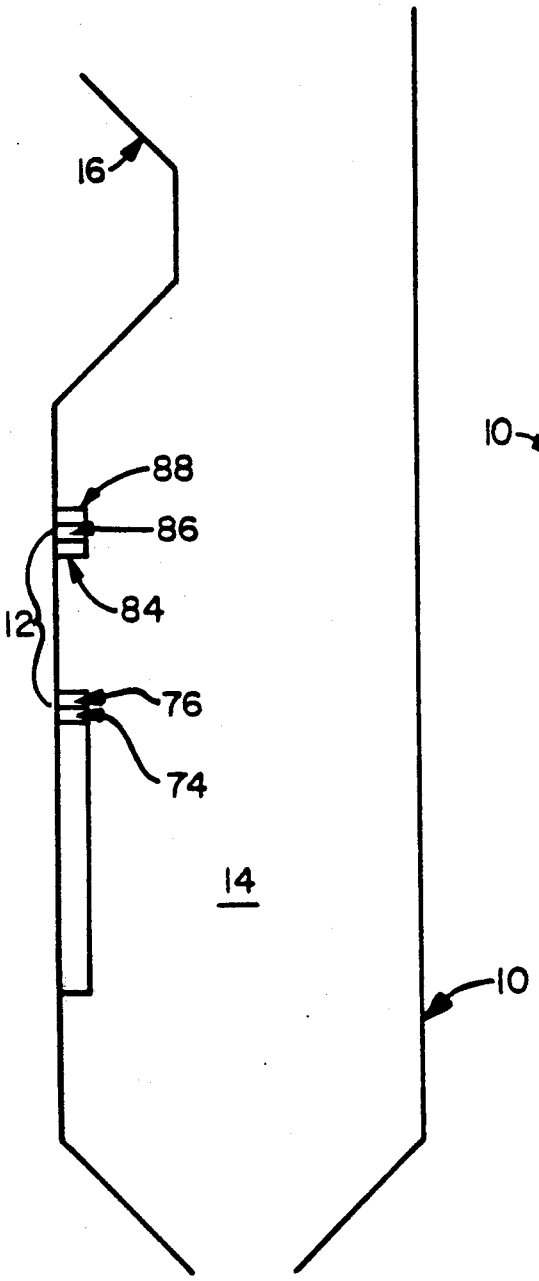
FIG. 6 is a graphical depiction of the overall furnace stoichiometry for a fossil fuel-fired furnace embodying a clustered concentric tangential firing system constructed in accordance with the present invention.

Continuing, the windbox 20 of the clustered concentric tangential firing system 12 constructed in accord with the present invention differs from a conventional windbox of a tangentially fired, fossil-fueled furnace in several ways. First, the fuel nozzles are mounted in clusters of two, seen at 38,40 and 68,70 in FIG. 2 of the drawing. Between the cluster of fuel nozzles 38,40 and 68,70 there are very large compartments 50,52,54 designed for receiving therein the offset air nozzles 56,58,60. Secondly, there are two overfire air systems instead of one. The close coupled overfire air nozzles, seen at 78,80 in FIG. 2 of the drawing, are located at the top of the windbox 20, but the separated overfire air nozzles, seen at 90,92,94 in FIG. 2 of the drawing, are separated from the windbox 20 but are aligned therewith in spaced relation thereto. As best understood with reference to FIG. 6 of the drawing, the combined capacity of both the close coupled overfire air nozzles 78,80 and the separated overfire air nozzles 90,92,94 is sufficient to run the windbox 20 below the close coupled overfire air nozzles 78,80 at a stoichiometry of about 0.85. On the other hand, again as best understood with reference to FIG. 6 of the drawing, the stoichiometry above the close coupled overfire air nozzles 78,80 is approximately 1.0.

A further description will now be had herein of the air nozzle 24. For this purpose, reference will be had in particular to FIG. 3 of the drawing. However, before proceeding with such a description of the air nozzle 24, note is taken of the fact that as described herein previously, the air nozzle 24 is suitably mounted at the lower end of the windbox 20 and with the windbox 20 in turn being suitably positioned within the burner region 14 of the furnace 10. Furthermore, such a windbox 20 is suitably located in each of the four corners of the furnace 10 so as to form an arrangement in which there essentially exists two pair of windboxes 20 and in which the windboxes 20 of each pair thereof are located so as to be diagonally opposed one to another and such that if an imaginary line were to be drawn therebetween this imaginary line would pass through the center of the furnace 10.

Figure 3:
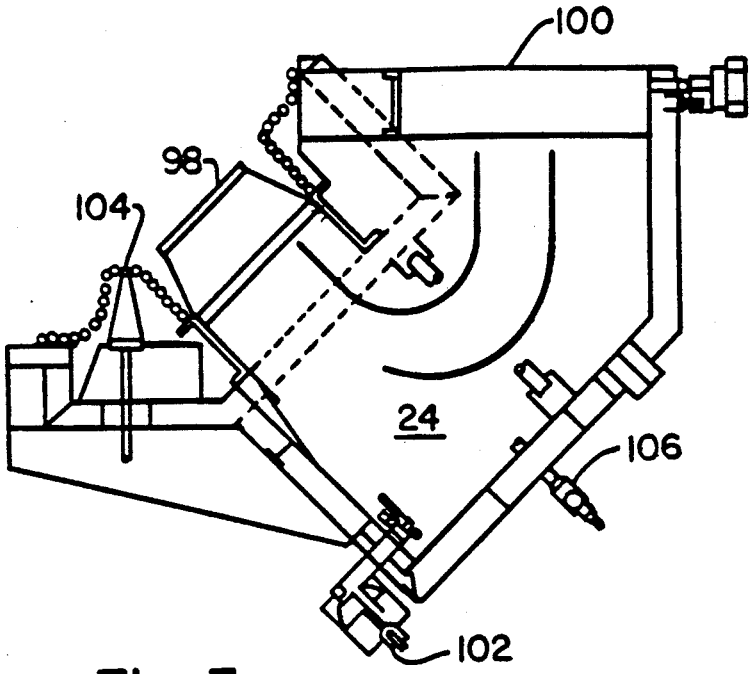
FIG. 3 is a plan view of an air compartment utilized in a clustered concentric tangential firing system constructed in accordance with the present invention.

With the proceeding as background, the air nozzle 24 in accordance with the illustration thereof in FIG. 3 of the drawing includes a nozzle tip, denoted by the reference numeral 98; a damper means, denoted by the reference numeral 100, operable for varying the amount of air flow that passes through the air nozzle 24; a tilt drive means, denoted by the reference numeral 102, operable for varying the angle of tilt which the nozzle tip 98 bears to the horizontal, i.e., to the horizontal plane in which the nozzle tip 98 lies; an igniter means, denoted by the reference means 104, operable for purposes of establishing a stable flame in proximity to the air nozzle 24 within the burner region 14 of the furnace 10; and a flame scanner means, denoted by the reference numeral 106, operable for detecting in proximity to the air nozzle 24 the absence of a flame within the burner region 14 of the furnace 10. Inasmuch as the particulars of the nature of the construction and the mode of operation of the air nozzle 24 beyond that which have been described hereinbefore are well-known to those skilled in this art, further reference thereto herein is not deemed to be necessary for one to obtain a clear understanding of the nature of the construction and the mode of operation of the clustered concentric tangential firing system 12 to which the present invention is directed. However, should a fuller understanding of the nature of the construction and/or the mode of operation of the air nozzle 24 be deemed desirable, reference may be had for this purpose to the prior art such as by way of exemplification and not limitation U.S. Pat. Nos. 3,285,319; 4,304,196 and 4,356,975.

Next, a further description will be had herein of the offset air nozzles 56,58 and 60. Inasmuch as the offset air nozzles 56,58 and 60 are all identical, a description will be had hereinafter of only one of the offset air nozzles 56,58 and 60. Moreover, in this connection reference will be had in particular to FIGS. 4 and 5 of the drawing wherein it will be assumed for purposes of the following description that the offset air nozzle depicted in FIG. 4 of the drawing is the offset air nozzle denoted by the reference numeral 56 in FIG. 2 of the drawing. However, as was done hereinbefore in connection with the further description of the air nozzle 24, it is deemed advisable before proceeding with the further description of the offset air nozzles 56,58 and 60 to take note herein once again of the fact that the offset air nozzles 56,58 and 60 are suitably mounted within the windbox 20 substantially in juxtaposed relation to the first cluster of fuel nozzles 38 and 40 and with the windbox 20 in turn being suitably positioned within the burner region 14 of the furnace 10. Further, such a windbox 20, as noted herein previously, is suitably located in each of the four corners of the furnace 10 so as to form an arrangement in which there essentially exists two pairs of windboxes and in which the windboxes 20 of each pair thereof are located so as to be diagonally opposed one to another and such that if an imaginary line were to be drawn therebetween this imaginary line would pass through the center of the furnace 10.

Figure 4:
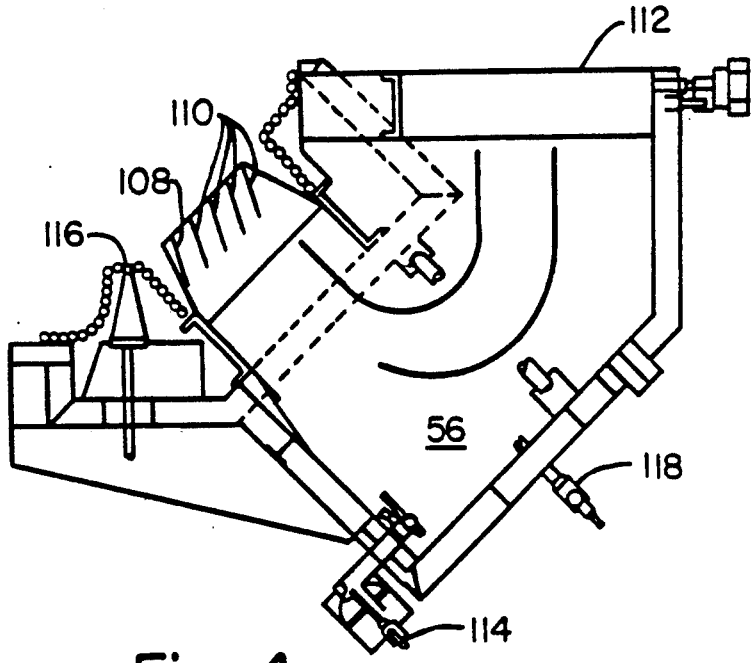
FIG. 4 is a plan view of an offset air compartment utilized in a clustered concentric tangential firing system constructed in accordance with the present invention.
Figure 5:
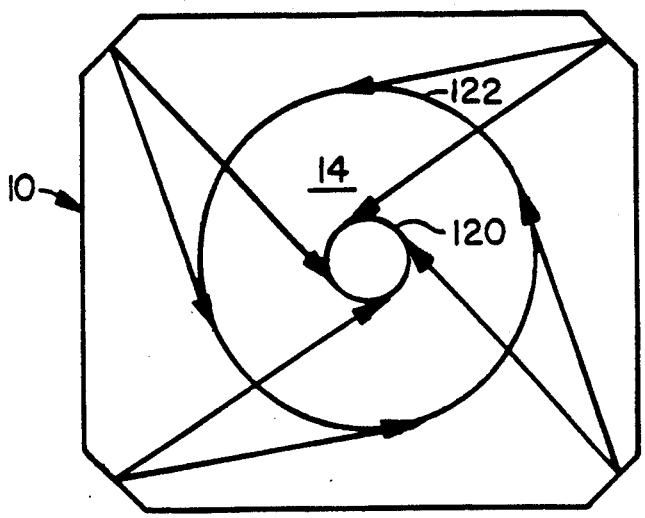
FIG. 5 is a plan view of a firing circle depicting the principle of offset firing.

Thus, with the proceeding as background, the offset air nozzles 56,58 and 60, in accordance with the illustration thereof in FIG. 4 of the drawing wherein as noted above it will be assumed for purposes of the description which follows hereinafter that the offset air nozzle depicted in FIG. 4 is offset air nozzle 56, each include a nozzle tip, denoted by the reference numeral 108, which nozzle tip 108 embodies for a purpose to be more fully described hereinafter a plurality of turning vanes, each for ease of reference thereto denoted by the same reference numeral 110; a damper means, denoted by the reference numeral 112, operable for varying the amount of air flow that passes through the offset air nozzle 56; a tilt drive means, denoted by the reference numeral 114, operable for varying the angle of tilt which the nozzle tip 108 bears to the horizontal, i.e., to the horizontal plane in which the nozzle tip 108 lies; an ignitor means, denoted by the reference numeral 116, operable for purposes of establishing a stable flame in proximity to the offset air nozzle 56 within the burner region 14 of the furnace 10; and a flame scanner, denoted by the reference numeral 118, operable for detecting in proximity to the offset air nozzle 56 the absence of a flame within the burner region 14 of the furnace 10. With further reference to the turning vanes 110 that are embodied in the nozzle tip 108, a discussion will now be had herein of the function performed thereby. For this purpose, reference will be had in particular to FIG. 5 of the drawing. To this end, as best understood with reference to FIG. 5, the fuel which is injected into the burner region 14 of the furnace 10 through the first cluster of fuel nozzles 38 and 40 and the second cluster of fuel nozzles 68 and 70 is directed towards the imaginary small circle denoted in FIG. 5 by the reference numeral 120 that is centrally located within the burner region 14 of the furnace 10. In contradistinction to the fuel, the air which is injected into the burner region 14 of the furnace 10 through the offset air nozzles 56,58 and 60 is as a consequence of the action of the turning vanes 110 directed towards the imaginary larger diameter circle denoted by the reference numeral 122 in FIG. 5 that by virtue of being concentric to the small circle 120 necessarily is like the small circle 120 also centrally located within the burner region 14 of the furnace 10. Thus, it should be readily apparent from a consideration of FIG. 5 of the drawing that by virtue of the action of the turning vanes 110 that are embodied in the nozzle tip 108 the air which is injected into the burner region 14 of the furnace 10 through the offset air nozzles 56,58 and 60 is directed towards the larger diameter circle 122, i.e., away from the fuel that is injected into the burner region 14 of the furnace 10 through the first cluster of fuel nozzles 38 and 40 and the second cluster of fuel nozzles 68 and 70 so as to be directed towards the small circle 120, and towards the walls of the furnace 10. As such, note is taken of the fact that the air which is introduced into the burner region 14 of the furnace 10 through the offset air nozzles 56,58 and 60 functions in the manner of "boundary air" so as to thereby protect the walls of the furnace 10 from the reducing atmosphere which exists within the furnace 10 when the furnace 10 is in operation. Finally, inasmuch as the particulars of the nature of the construction and the mode of operation of the offset air nozzles 56,58 and 60 beyond that which have been described hereinbefore are well-known to those skilled in this art, further reference thereto herein is not deemed to be necessary for one to obtain a clear understanding of the nature of the construction and the mode of operation of the clustered concentric tangential firing system 12 to which the present invention is directed. However, should a fuller understanding of the nature of the construction and/or the mode of operation of the offset air nozzles 56,58 and 60 be deemed desirable, reference may be had for this purpose to the prior art.

Figure 7:
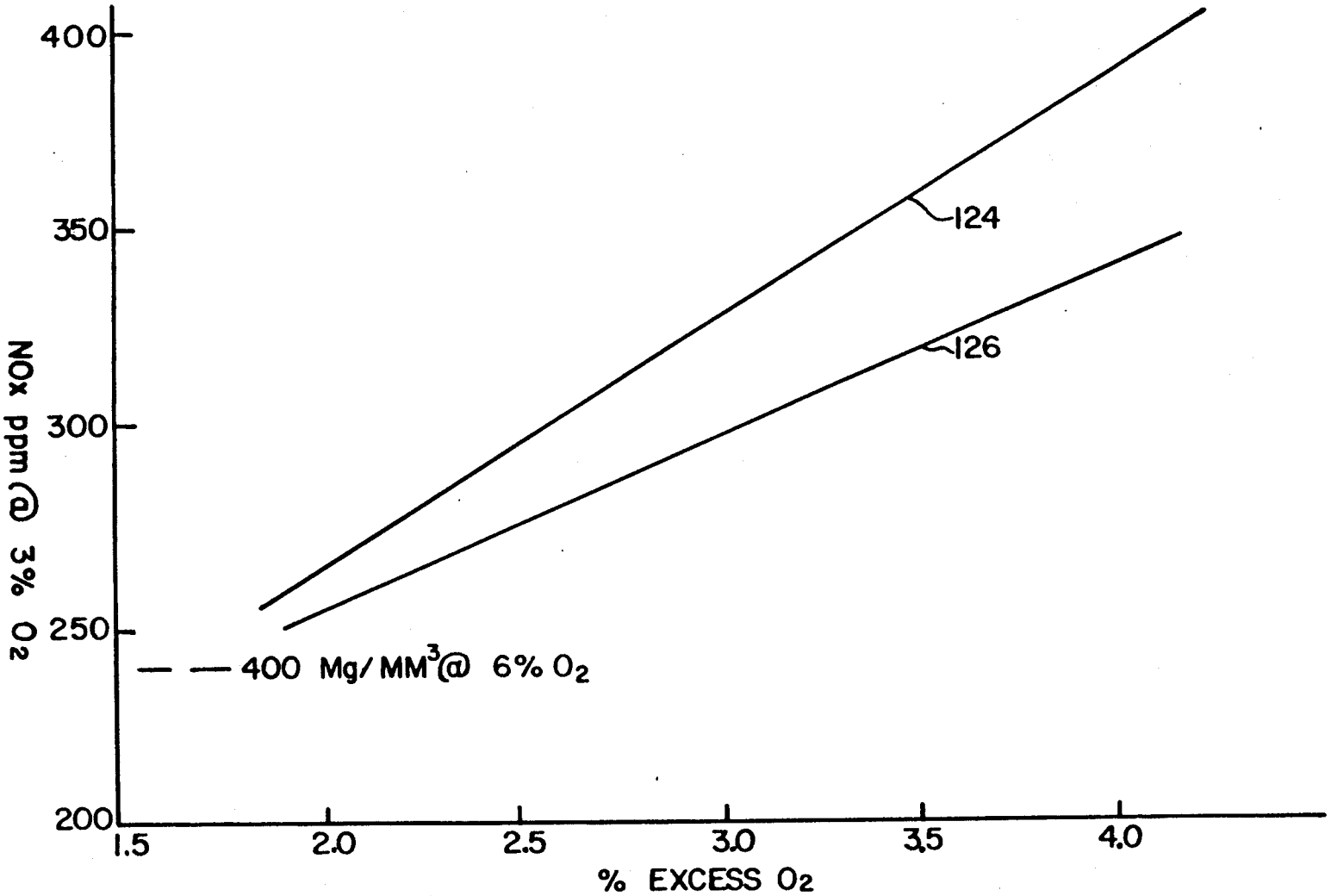
FIG. 7 is a graphical depiction of the comparison of the $NO_x$ ppm levels attained in a fossil fuel-fired furnace both through the use of a heretofore standard type of firing system and through the use of a clustered concentric tangential firing system constructed in accordance with the present invention.

Reference will next be had to FIG. 7 of the drawing which as noted herein previously contains a graphical depiction of the comparison of the $NO_x$ ppm levels attained in a fossil fuel-fired furnace, such as the furnace 10, through the use of a heretofore standard type of firing system as well as through the use of the clustered concentric tangential firing system constructed in accordance with the present invention. In FIG. 7, the line denoted by the reference numeral 124 is a plot of the $NO_x$ ppm levels attained in a fossil fuel-fired furnace, such as the furnace 10, which is equipped with a heretofore standard type of firing system whereas the line denoted by the reference numeral 126 in FIG. 7 is a plot of the $NO_x$ ppm levels attained in a fossil fuel-fired furnace, such as the furnace 10, which is equipped with the clustered concentric tangential firing system 12 constructed in accordance with the present invention. From FIG. 7 of the drawing it can be seen that by employing the clustered concentric tangential firing system 12 constructed in accordance with the present invention wherein the fuel nozzles 38,40,68 and 70 are grouped into "clusters" as compared to employing a heretofore standard type of firing system wherein the fuel nozzles thereof are not so grouped into "clusters", it is possible to reduce $NO_x$ emissions by 10% to 15% at normal excess air levels, i.e., 2.5% to 3.5% $O_2$, and wherein moderate levels of overfire air, i.e., 20%, are being utilized. From the tests that were conducted upon which the data depicted in FIG. 7 of the drawing is based, it was further shown that the above results achievable through the grouping in the clustered concentric tangential firing system 12 constructed in accordance with the present invention of the fuel nozzles 38,40,68 and 70 into "clusters" are attainable at the same time that the target $NO_x$ emission levels of 400 mg/Nm3 at 6% $O_2$, i.e., 0.32 1b/MBtu or 240 ppm at 3% 02, are being achieved with 30% overfire air while operating at an excess air level of 3% to 4% $O_2$ and with no statistical increase in unburned carbon emissions. This compares to a $NO_x$ emission level of 475 ppm when employing under the same conditions a heretofore standard type of firing system. As such, there is achieved at these conditions a greater than 50% reduction in $NO_x$ emission levels when the clustered concentric tangential firing system 12 constructed in accordance with the present invention is utilized as constructed to when a heretofore standard type of firing system is utilized.

A description will now be set forth herein of another embodiment of a clustered concentric tangential firing system constructed in accordance with the present invention. More specifically, there will now be described herein a form of clustered concentric tangential firing system, constructed in accordance with the present invention, which is particularly suited for use in a multi-fuel coal-capable furnace. For purposes of this description, reference will be had in particular to FIG. 8 of the drawing wherein a clustered concentric tangential firing system denoted generally therein by the reference numeral 128, which is especially suited for use in a multi-fuel coal-capable furnace, is illustrated. In accordance with the embodiment thereof illustrated in FIG. 8 of the drawing, the clustered concentric tangential firing system 128 is depicted as including three pairs of fuel compartments, seen at 130 and 132,134 and 136, and 138 and 140 in FIG. 8. However, it is to be understood that without departing from the essence of the present invention the clustered concentric tangential firing system 128 could include fewer pairs of fuel compartments such as the number that exist in the case of the clustered concentric tangential firing system 12 which has been described hereinbefore, or more pairs of fuel compartments (not shown).

Figure 8:
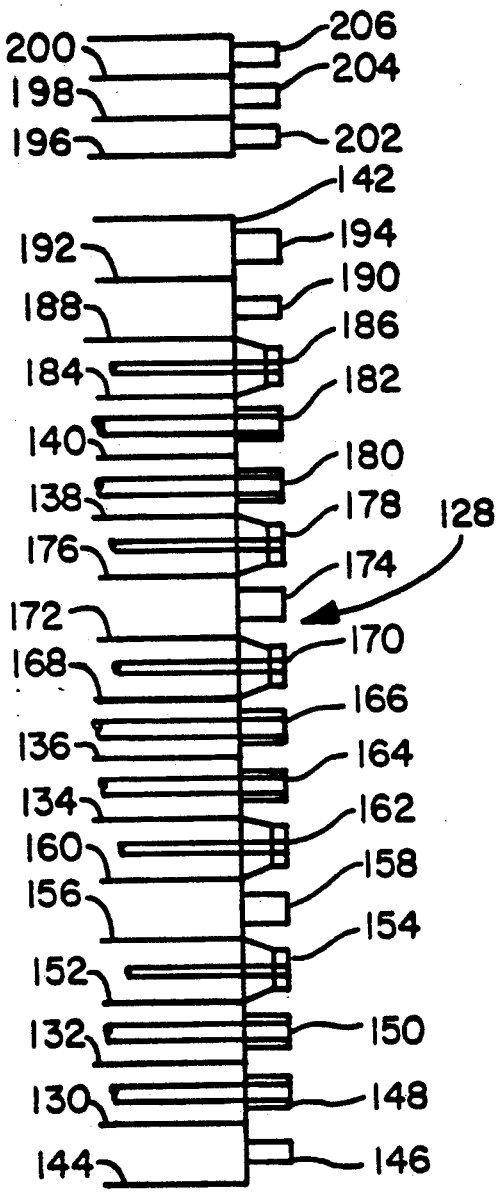
FIG. 8 is a diagrammatic representation in the nature of a vertical sectional view of another embodiment of a clustered concentric tangential firing system, which is particularly suited for use in oil/gas firing applications, constructed in accordance with the present invention.

Continuing, the clustered concentric tangential firing system 128 embodies, in accordance with the illustration thereof in FIG. 8 of the drawing, the following construction. Namely, the clustered concentric tangential firing system 128 includes a housing preferably in the form of a windbox denoted by the reference numeral 142 in FIG. 8. A first air compartment denoted by the reference numeral 144 is provided at the lower end, as viewed with reference to FIG. 8, of the windbox 142. An air nozzle denoted by the reference numeral 146 is supported in mounted relation by conventional means within the air compartment 144. A first pair of fuel compartments 130 and 132, to which reference has been had hereinbefore, is provided in the windbox 144 within the lower portion thereof, as viewed with reference to FIG. 8, such as to be located substantially in juxtaposed relation to the air compartment 144. A first cluster of fuel nozzles denoted by the reference numerals 148 and 150 is supported in mounted relation by conventional means within the pair of fuel compartments 130 and 132 such that the fuel nozzle 148 is mounted in the fuel compartment 130 and the fuel nozzle 150 is mounted in the fuel compartment 132. A first oil/gas compartment denoted by the reference numeral 152 is provided in the windbox 144 such as to be located substantially in juxtaposed relation to the fuel compartment 132. A fuel nozzle denoted by the reference numeral 154 is supported in mounted relation by conventional means within the oil/gas compartment 152. It is to be understood that in the case of an oil application the fuel nozzle 154 would comprise an oil nozzle whereas in the case of a gas application the fuel nozzle 154 would comprise a gas nozzle. A first offset air compartment denoted by the reference numeral 156 is provided in the windbox 144 such as to be located substantially in juxtaposed relation to the oil/gas compartment 152. An offset air nozzle denoted by the reference numeral 158 is supported in mounted relation by conventional mounting means within the offset air compartment 156. A second oil/gas compartment denoted by the reference numeral 160 is provided in the windbox 144 such as to be located substantially in juxtaposed relation to the offset air compartment 156. A fuel nozzle denoted by the reference numeral 162 is supported in mounted relation by conventional means within the oil/gas compartment 160. It is to be understood that in the case of an oil application the fuel nozzle 162 would comprise an oil nozzle whereas in the case of a gas application the fuel nozzle 162 would comprise a gas nozzle. A second pair of fuel compartments 134 and 136, to which reference has been had hereinbefore, is provided in the windbox 144 such as to be located substantially in juxtaposed relation to the oil/gas compartment 160. A second cluster of fuel nozzles denoted by the reference numerals 164 and 166 is supported in mounted relation by conventional means within the pair of fuel compartments 134 and 136 such that the fuel nozzle 164 is mounted in the fuel compartment 134 and the fuel nozzle 166 is mounted in the fuel compartment 136.

With further regard to the description of the clustered concentric tangential firing system 128 constructed as illustrated in FIG. 8 of the drawing, a third oil/gas compartment denoted by the reference numeral 168 is provided in the windbox 144 such as to be located substantially in juxtaposed relation to the fuel compartment 136. A fuel nozzle denoted by the reference numeral 170 is supported in mounted relation by conventional means within the oil/gas compartment 168. It is to be understood that in the case of an oil application the fuel nozzle 170 would comprise an oil nozzle whereas in the case of a gas application the fuel nozzle 170 would comprise a gas nozzle. A second offset air compartment denoted by the reference numeral 172 is provided in the windbox 144 such as to be located substantially in juxtaposed relation to the oil/gas compartment 170. An offset air nozzle denoted by the reference numeral 174 is supported in mounted relation by conventional mounting means within the offset air compartment 172. A fourth oil/gas compartment denoted by the reference numeral 176 is provided in the windbox 144 such as to be located substantially in juxtaposed relation to the offset air compartment 172. A fuel nozzle denoted by the reference numeral 178 is supported in mounted relation by conventional means within the oil/gas compartment 176. It is to be understood that in the case of an oil application the fuel nozzle 178 would comprise an oil nozzle whereas in the case of a gas application the fuel nozzle 178 would comprise a gas nozzle. A third pair of fuel compartments 138 and 140, to which reference has been had hereinbefore, is provided in the windbox 144 such as to be located substantially in juxtaposed relation to the oil/gas compartment 176. A third cluster of fuel nozzles denoted by the reference numerals 180 and 182 is supported in mounted relation by conventional means within the pair of fuel compartments 13B and 140 such that the fuel nozzle 180 is mounted in the fuel compartment 138 and the fuel nozzle 182 is mounted in the fuel compartment 140. A fifth oil/gas compartment denoted by the reference numeral 184 is provided in the windbox 144 such as to be located substantially in juxtaposed relation to the fuel compartment 140. A fuel nozzle denoted by the reference numeral 186 is supported in mounted relation by conventional means within the oil/gas compartment 184. It is to be understood that in the case of an oil application the fuel nozzle 186 would comprise an oil nozzle whereas in the case of a gas application the fuel nozzle 186 would comprise a gas nozzle. A second air compartment denoted by the reference numeral 188 is provided in the windbox 144 such as to be located substantially in juxtaposed relation to the oil/gas compartment 186. An air nozzle denoted by the reference numeral 190 is supported in mounted relation by conventional means within the air compartment 188.

Completing the description of the clustered concentric tangential firing system 128 constructed as illustrated in FIG. 8 of the drawing, a close coupled overfire air compartment denoted by the reference numeral 192 is provided in the windbox 144 within the upper portion thereof such as to be located substantially in juxtaposed relation to the air compartment 188. A close coupled overfire air nozzle denoted by the reference numeral 194 is supported in mounted relation by conventional means within the close coupled overfire air compartment 192. A plurality of separated overfire air compartments are suitably supported in spaced relation to the close coupled overfire air compartment 192 and so as to be substantially aligned with the longitudinal axis of the windbox 144. The aforereferenced plurality of separated overfire air compartments, in accordance with the embodiment of the clustered concentric tangential firing system 128 that is illustrated in FIG. 8 of the drawing, comprises in number three such compartments, which are denoted by the reference numerals 196,198 and 200, respectively. A plurality of separated overfire air nozzles denoted by the reference numerals 202,204 and 206, respectively, are supported in mounted relation by conventional means within the plurality of separated overfire air compartments 196,198 and 200 such that the separated overfire air nozzle 202 is mounted in the separated overfire air compartment 196, the separated overfire air nozzle 204 is mounted in the separated overfire air compartment 198, and the separated overfire air nozzle 206 is mounted in the separated overfire air compartment 200.

Although not depicted in FIG. 8 of the drawing, it is to be understood that the air nozzles 146 and 190, the offset air nozzles 158 and 174, the close coupled overfire air nozzle 194 and the separated overfire air nozzles 202,204 and 206 are each operatively connected in a manner similar to that depicted in FIG. 1 of the drawing to an air supply means such as the air supply means 26 shown in FIG. 1 whereby air is supplied from a fan such as the fan 28 to each of the air nozzles 146 and 190, each of the offset air nozzles 158 and 174, the close coupled overfire air nozzle 194 and each of the separated overfire air nozzles 202,204 and 206, and therethrough into the burner region such as the burner region 14 of the furnace such as the furnace 10 that is equipped with the clustered concentric tangential firing system 144 which is illustrated in FIG. 8. Likewise, each of the fuel nozzles 148,150,164,166,180 and 182 is operatively connected in a manner similar to that depicted in FIG. 1 of the drawing to a fuel supply means such as the fuel supply means 42 shown in FIG. 1 whereby coal is supplied from a pulverizer such as the pulverizer 44 to each of the fuel nozzles 148,150,164,166,180 and 182 and therethrough into the burner region such as the burner region 14 of the furnace such as the furnace 10 that is equipped with the clustered concentric tangential firing system 144 which is illustrated in FIG. 8. Finally, each of the fuel nozzles 154,162,170,178 and 186 is operatively connected in a manner similar to that described hereinabove in connection with the discussion of the fuel nozzles 148,150,164,166,180 and 182 to a fuel supply means which is constructed in a fashion similar to that of the fuel supply means 42 whereby fuel in the form of oil in the case of an oil application and gas in the case of a gas application is supplied from a suitable source of oil or gas as the case may be to each of the fuel nozzles 154,162,170,17B and 186 and therethrough into the burner region such as the burner region 14 of the furnace 10 that is equipped with the clustered concentric tangential firing system 144 which is illustrated in FIG. 8.

Figure 9:
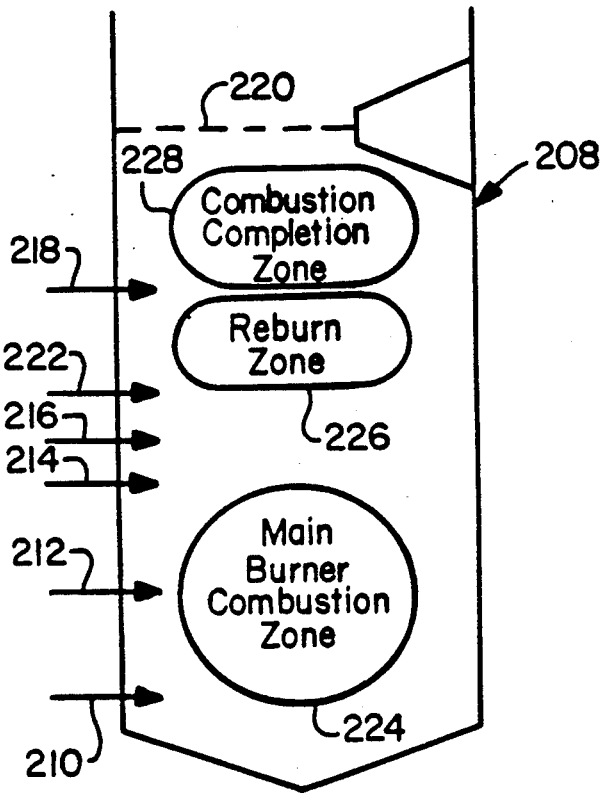
FIG. 9 is a diagrammatic representation in the nature of a vertical sectional view of a fossil fuel-fired furnace equipped both with a clustered concentric tangential firing system constructed in accordance with the present invention and for reburning.

Turning next to a consideration of FIG. 9 of the drawing, a fossil fuel-fired furnace has been depicted therein which is equipped both for reburning and with a clustered concentric tangential firing system. A description will now be had herein of the manner in which this is accomplished. For purposes of this description, one is to assume that the fossil fuel-fired furnace depicted in FIG. 9 wherein the fossil fuel-fired furnace is denoted generally by the reference numeral 208 is equipped with a clustered concentric tangential firing system embodying the same configuration as that of the clustered concentric tangential firing system 12 which is illustrated in FIGS. 1 and 2 of the drawing. Inasmuch as the nature of the construction of the clustered concentric tangential firing system 12 has been described herein in detail previously, it is not deemed necessary to now repeat this description herein again in order for one skilled in the art to understand the manner in which the furnace 208 is equipped both for reburning and with a clustered concentric tangential firing system 12. Rather, it is deemed sufficient to merely take note of the fact that the arrow denoted by the reference numeral 210 schematically represents the relative location within the furnace 208 of the first cluster of fuel nozzles 38 and 40 of the clustered concentric tangential firing system 12, that the arrow denoted by the reference numeral 212 schematically represents the relative location within the furnace 208 of the offset air nozzles 56,58 and 60 of the clustered concentric tangential firing system 12, that the arrow denoted by the reference numeral 214 schematically represents the relative location within the furnace 208 of the second cluster of fuel nozzles 68 and 70 of the clustered concentric tangential firing system 12, that the arrow denoted by the reference numeral 216 schematically represents the relative location within the furnace 208 of the close coupled overfire air nozzles 78 and 80 of the clustered concentric tangential firing system 12 and that the arrow denoted by the reference numeral 216 schematically represents the relative location within the furnace 208 of the separated overfire air nozzles 90,92 and 94 of the clustered concentric tangential firing system 12.

With further regard to the furnace 208 that as illustrated in FIG. 9 of the drawing is equipped both for reburning and with the clustered concentric tangential firing system 12, note is taken herein of the fact that for a purpose which should become readily apparent subsequently the outlet from the furnace 208 has been depicted schematically in FIG. 9 by the dotted line that is denoted therein by the reference numeral 220, and that the fuel which is employed for purposes of reburning is injected into the furnace 208 at the location which has been schematically represented in FIG. 9 by means of the arrow denoted therein by the reference numeral 222. The reburning fuel that is employed in this connection preferably takes the form of an unburned fuel such as natural gas as well as recirculated flue gas. To this end, the reburn fuel is injected into the furnace 208 at the location denoted by the arrow 222 in FIG. 9 by means of any conventional form of fuel nozzle that is capable of being utilized for such a purpose.

As best understood with reference to FIG. 9 of the drawing, the furnace 208 includes essentially three zones; namely, the main burner combustion zone denoted by the reference numeral 224 located in the lower portion of the furnace 208 as viewed with reference to FIG. 9, the reburn zone denoted by the reference numeral 226 located downstream of the main burner combustion zone 224, i.e., in the central portion of the furnace 208 as viewed with reference to FIG. 9, and the combustion completion zone denoted by the reference numeral 228 located downstream of the reburn zone 226, i.e., in the upper portion of the furnace 208 as viewed with reference to FIG. 9. It is within the main burner combustion zone 224 that the operation of the clustered concentric tangential firing system 12 principally takes place. To this end, this is where in accordance with the mode of operation of the clustered concentric tangential firing system 12 that, as has been described previously herein in more detail, air is introduced into the furnace 208 at a first level thereof; clustered fuel is introduced into the furnace 208 at a second level thereof, i.e., at the location denoted by the arrow 210, so as to create a first fuel-rich zone within the furnace 208; offset air is introduced into the furnace 208 at a third level thereof, i.e., at the location denoted by the arrow 212 such that the offset air is directed away from the clustered fuel previously injected into the furnace 208 and towards the walls of the furnace 208; additional clustered fuel is introduced into the furnace 208 at a fourth level thereof, i.e., at the location denoted by the arrow 214 so as to create a second fuel-rich zone within the furnace 208; and close coupled overfire air is introduced into the furnace 208 at a fifth level thereof, i.e., at the location denoted by the arrow 216. Further, note is made here of the fact that the separated overfire air which forms a part of the clustered concentric tangential firing system 12 constructed in accordance with the present invention is not injected into the furnace 208 within the main burner combustion zone 224, but rather is injected into the furnace 208 downstream of the reburn zone 226, i.e., at the location denoted by the reference numeral 218 which as best understood with reference to FIG. 9 of the drawing lies between the reburn zone 226 and the combustion completion zone 228.

The reburning fuel, as denoted by the arrow 222 in FIG. 9 of the drawing, is injected downstream of the main burner combustion zone 224 to create a fuel rich reduction zone that has been designated in FIG. 9 as the reburn zone 226. The nitrogen entering the reburn zone 226 comes from the following four sources: $NO_x$, $N_2$, $N_2O$ leaving the main burner combustion zone 224, and the fuel nitrogen that is present in the reburning zone. These fuel nitrogen species apparently decompose initially to produce HCN which is then converted to $NH_3$, $NH_2$, —, and N species. These amines can react either with NO or other amines to produce $N_2$ or with the O and OH to produce $NO_x$. If the conversion to $N_2$ is not complete, some nitrogen reactive containing species such as NO, char nitrogen, $NH_3$, and HCN would persist to the end of the reburn zone 226. Therefore, in order to maximize $NO_x$ reduction by reburning, it is necessary to minimize the total reactive nitrogen species leaving the reburn zone 226.

In the combustion completion zone 228, the air that is added in the form of separated overfire air at the location denoted by the arrow 218 in FIG. 9 is operative to produce overall lean conditions in order to oxidize the remaining fuel in the upper portion of the furnace 208, but under these conditions any reactive nitrogen is mainly converted to $NO_x$ It is vital, therefore, that $O_2$ levels in the combustion completion zone 228 be minimized to prevent significant increases in $NO_x$ emissions during this final stage of the combustion process that takes place within the furnace 208.

In conclusion, it should be apparent from the preceding description that two discrete combustion stages, i.e., the main burner combustion zone 224 and the complete combustion zone 228, are created in the furnace 208 where the combustion stoichiometry of each stage is independently controlled. Moreover, adjusting the combustion stoichiometry in different stages within the furnace 208 renders it possible to achieve lower emission levels of $NO_x$ than with other combustion modification techniques.

Thus, in accordance with the present invention there

Thus, in accordance with the present invention there has been provided a new and improved $NO_x$ emission reducing firing system for use in fossil fuel-fired furnaces. Plus, there is provided in accord with the present invention a $NO_x$ emission reducing firing system for fossil fuel-fired furnaces that is particularly suited for use in tangentially-fired, pulverized coal furnaces. Besides, in accordance with the present invention there has been provided a $NO_x$ emission reducing firing system for fossil fuel-fired furnaces which is characterized in that through the use thereof $NO_x$ emissions are capable of being reduced to levels that are at least equivalent to if not better than that which is currently being contemplated as the standard for the U.S. in the legislation being proposed. As well, there is provided in accord with the present invention a $NO_x$ emission reducing firing system for fossil fuel-fired furnaces which is characterized in that through the use thereof $NO_x$ emission reductions are capable of being achieved of as much as 50% to 60% from that which would otherwise be emitted from fossil fuel-fired furnaces which are equipped with prior art forms of firing systems. Moreover, in accordance with the present invention there has been provided a $NO_x$ emission reducing firing system which is characterized in that through the use thereof several layers of fuel-rich zones are established in the furnace burner area. Also, there is provided in accord with the present invention a $NO_x$ emission reducing firing system for fossil fuel-fired furnaces which is characterized in that through the use thereof immediate ignition and associated high temperature are facilitated with the concomitant effect that release of the organically-bound nitrogen from the pulverized coal being fired in the furnace is introduced into the large fuel-rich zones. Further, in accordance with the present invention there is provided a $NO_x$ emission reducing firing system for fossil fuel-fired furnaces which is characterized in that through the use thereof there is accomplished stabilization of the flame front as well as the initial devolatilization within the fuel-rich zones of the fuel-bound nitrogen whereby the fuel-bound nitrogen is converted to $N_2$ in the fuel-rich zones. In addition, there is provided in accord with the present invention a $NO_x$ emission reducing firing system for fossil fuel-fired furnaces which is characterized in that through the use thereof sufficient overfire air is provided to permit the completion of efficient combustion of the fuel rich furnace gases before these gases reach the convective pass of the furnace. Furthermore, in accordance with the present invention there is provided a $NO_x$ emission reducing firing system for fossil fuel-fired furnaces which is characterized in that through the use thereof no additions, catalysts or added premium fuel costs are needed for the operation thereof. Additionally, there is provided in accord with the present invention a $NO_x$ emission reducing firing system for fossil fuel-fired furnaces which is characterized in that provisions are incorporated therein for eliminating waterwall corrosion which is produced during deep staged combustion operation. Penultimately, in accordance with the present invention there is provided a $NO_x$ emission reducing firing system for fossil fuel-fired furnaces which is characterized in that it is totally compatible with other emission reduction-type systems such as limestone injection systems, reburn systems and selective catalytic reduction (SCR) systems that one might seek to employ in order to accomplish additional emission reduction. Finally, there is provided in accord with the present invention a $NO_x$ emission reducing firing system for fossil fuel-fired furnaces which is characterized in that it is equally well suited for use either in new applications or in retrofit applications.

While several embodiments of our invention have been shown, it will be appreciated that modifications thereof, some of which have been alluded to hereinabove, may still be readily made thereto by those skilled in the art. We, therefore, intend by the appended claims to cover the modifications alluded to herein as well as all the other modifications which fall within the true spirit and scope of our invention.

What is claimed is:

1. In a fossil fuel-fired furnace having a plurality of walls embodying therewithin a burner region, a clustered concentric tangential firing system comprising:

a. a windbox mounted within the burner region of the fossil fuel-fired furnace;

b. a first pair of fuel compartments mounted at a first elevation within said windbox;

c. a cluster of fuel nozzles supported in mounted relation within said first pair of fuel compartments;

d. an air compartment mounted at a second elevation within said windbox such as to be located substantially in juxtaposed relation to said first pair of fuel compartments;

e. an air nozzle supported in mounted relation within said air compartment;

f. a second pair of fuel compartments mounted at a third elevation within said windbox;

g. a pair of fuel nozzles supported in mounted relation within said second pair of fuel compartments;

h. a close coupled overfire air compartment mounted at a fourth elevation within said windbox;

i. a close coupled overfire air nozzle supported in mounted relation within said close coupled overfire air compartment;

j. a separated overfire air compartment mounted within the burner region of the fossil fuel-fired furnace so as to be spaced from said close coupled overfire air compartment and so as to be substantially aligned with the longitudinal axis of said windbox;

k. a separated overfire air nozzle supported in mounted relation within said separated overfire air compartment;

l. a fuel supply means connected to said cluster of fuel nozzles and to said pair of fuel nozzles, said fuel supply means being operative to supply fuel to said cluster of fuel nozzles and therethrough into the burner region of the fossil fuel-fired furnace so as to create a fuel-rich zone therewithin, said fuel supply means further being operative to supply fuel to said pair of fuel nozzles and therethrough into the burner region of the fossil fuel-fired furnace; and m. an air supply means connected to said air nozzle, to said close coupled overfire air nozzle and to said separated overfire air nozzle, said air supply means being operative to supply a sufficient amount of air to said air nozzle and to said close coupled overfire air nozzle and therethrough into the burner region of the fossil fuel-fired furnace so that the stoichiometry within said windbox is approximately 0.85, said air supply means further being operative to supply a sufficient amount of air to said separated overfire air nozzle and therethrough into the burner region of the fossil fuel-fired furnace so that the stoichiometry within the burner region of the fossil fuel-fired furnace above said windbox is approximately 1.0.

2. The clustered concentric tangential firing system as set forth in claim 1 wherein said air compartment comprises an offset air compartment, said air nozzle comprises an offset air nozzle, and said air supply means is operative to supply air to said offset air nozzle and therethrough into the burner region of the fossil fuel-fired furnace such that the air within the burner region of the fossil fuel-fired furnace is directed away from the clustered fuel that has been injected into the burner region of the fossil fuel-fired furnace and towards the walls of the fossil fuel-fired furnace.

3. The clustered concentric tangential firing system as set forth in claim 2 further comprising two additional offset air compartments mounted at said second elevation within said windbox and two additional offset air nozzles supported in mounted relation within said two additional offset air compartments, and wherein said air supply means is connected to said two additional offset air nozzles and is operative to supply air to said two additional offset air nozzles and therethrough into the burner region of the fossil fuel-fired furnace such that the air within the burner region of the fossil fuel-fired is directed away from the clustered fuel that has been injected into the burner region of the fossil fuel-fired furnace and towards the walls of the fossil fuel-fired furnace.

4. The clustered concentric tangential firing system as set forth in claim 1 further comprising another air compartment mounted at a fifth elevation within said windbox such as to be located substantially in juxtaposed relation to said first pair of fuel compartments and another air nozzle supported in mounted relation within said another air compartment, and wherein said air supply means is connected to said another air nozzle and is operative to supply air to said another air nozzle and therethrough into the burner region of the fossil fuel-fired furnace.

5. The clustered concentric tangential firing system as set forth in claim 1 further comprising an additional close coupled overfire air compartment mounted at said fourth elevation within said windbox and an additional close coupled overfire air nozzle supported in mounted relation within said additional close coupled overfire air compartment, and wherein said air supply means is connected to said additional close coupled overfire air nozzle and is operative to supply air to said additional close coupled overfire air nozzle and therethrough into the burner region of the fossil fuel-fired furnace.

6. The clustered concentric tangential firing system as set forth in claim 1 further comprising two additional separated overfire air compartments mounted within the burner region of the fossil fuel-fired furnace so as to be located in juxtaposed relation to said separated overfire air compartment and two additional separated overfire air nozzles supported in mounted relation within said two additional separated overfire air nozzles, and wherein said air supply means is connected to said two additional separated overfire air nozzles and is operative to supply air to said two additional separated overfire air nozzles and therethrough into the burner region of the fossil fuel-fired furnace.

7. The clustered concentric tangential firing system as set forth in claim 1 further comprising reburn means mounted in the burner region of the fossil fuel-fired furnace so as to be located between said close coupled overfire air compartment and said separated overfire air compartment, said reburn means being operative to inject reburn fuel into the burner region of the fossil fuel-fired furnace.

8. The clustered concentric tangential firing system as set forth in claim 1 further comprising a first pair of multi-fuel compartments, one of said pair of multi-fuel compartments being mounted in said windbox on either side of said air compartment, a first pair of multi-fuel nozzles supported in mounted relation within said first pair of multi-fuel compartments, and a multi-fuel supply means connected to said first pair of multi-fuel nozzles and being operative to supply multi-fuels to said first pair of multi-fuel nozzles and therethrough into the burner region of the fossil fuel-fired furnace.

9. The clustered concentric tangential firing system as set forth in claim 8 wherein said air compartment comprises a first offset air compartment, said air nozzle comprises a first offset air nozzle, and said air supply means is operative to supply air to said first offset air nozzle and therethrough into the burner region of the fossil fuel-fired furnace such that the air within the burner region of the fossil fuel-fired furnace is directed away from the clustered fuel that has been injected into the burner region of the fossil fuel-fired furnace and towards the walls of the fossil fuel-fired furnace.

10. The clustered concentric tangential firing system as set forth in claim 9 further comprising a second pair of multi-fuel compartments mounted in said windbox such as to be located substantially in juxtaposed relation to said second pair of fuel compartments, a second pair of multi-fuel nozzles supported in mounted relation within said second pair of multi-fuel compartments, said multi-fuel supply means being connected to said second pair of multi-fuel nozzles and being operative to supply multi-fuels to said second pair of multi-fuel nozzles and therethrough into the burner region of the fossil fuel-fired furnace.

11. The clustered concentric tangential firing system as set forth in claim 10 further comprising a second offset air compartment mounted in said windbox so as to be interposed between said second pair of multi-fuel compartments, a second offset air nozzle supported in mounted relation within said second offset air compartment, said air supply means being connected to said second offset air nozzle and being operative to supply air to said second offset air nozzle and therethrough into the burner region of the fossil fuel-fired furnace such that the air within the burner region of the fossil fuel-fired furnace is directed away from the clustered fuel that has been injected into the burner region of the fossil fuel-fired furnace and towards the walls of the fossil fuel-fired furnace.

12. The clustered concentric tangential firing system as set forth in claim 11 further comprising a third pair of fuel compartments mounted in said windbox such as to be located substantially in juxtaposed relation to said second pair of multi-fuel compartments, a cluster of fuel nozzles supported in mounted relation within said third pair of fuel compartments, said fuel supply means being connected to said cluster of fuel nozzles and being operative to supply fuel to said cluster of fuel nozzles and therethrough into the burner region of the fossil fuel-fired furnace so as to create a fuel-rich zone therewithin.

13. The clustered concentric tangential firing system as set forth in claim 12 further comprising a single multi-fuel compartment mounted in said windbox such as to be located substantially in juxtaposed relation to said third pair of fuel compartments, a single multi-fuel nozzle supported in mounted relation within said single multi-fuel compartment, and said multi-fuel supply means being connected to said single multi-fuel nozzle and being operative to supply multi-fuels to said single multi-fuel nozzle and therethrough into the burner region of the fossil fuel-fired furnace.

14. The clustered concentric tangential firing system as set forth in claim 13 further comprising a pair of air compartments mounted within said windbox such that one of said pair of air compartments is located substantially in juxtaposed relation to said first pair of fuel compartments and such that the other of said pair of air compartments is located substantially in juxtaposed relation to said single multi-fuel compartment, a pair of air nozzles supported in mounted relation within said pair of air compartments, said air supply means being connected to said pair of air compartments and being operative to supply air to said pair of air nozzles and therethrough into the burner region of the fossil fuel-fired furnace.

15. The clustered concentric tangential firing system as set forth in claim 14 further comprising two additional separated overfire air compartments mounted within the burner region of the fossil fuel-fired furnace so as to be located in juxtaposed relation to said separated overfire air compartment and two additional separated overfire air nozzles supported in mounted relation within said two additional separated overfire air nozzles, and wherein said air supply means is connected to said two additional separated overfire air nozzles and is operative to supply air to said two additional separated overfire air nozzles and therethrough into the burner region of the fossil fuel-fired furnace.

16. A method of operating a fossil fuel-fired furnace having a plurality of walls embodying a burner region therewithin for purposes of achieving better control over the availability of oxygen to the fuel throughout the combustion process so that by maximizing the separation of the fuel and air in the early stages of combustion very low $NO_x$ emissions are attained with minimal impact on the normal operation of the furnace comprising the steps of:

a. injecting clustered fuel into the burner region of the furnace so as to create a fuel-rich zone therewithin;

b. injecting additional fuel into the burner region of the furnace;

c. injecting offset air into the burner region of the furnace between the fuel-rich zone therewithin and the additional fuel zone therewithin such that the offset air is directed away from the clustered fuel and from the additional fuel injected into the burner region of the furnace and towards the walls of the furnace;

d. injecting close coupled overfire air into the burner region of the furnace above the additional fuel zone in a sufficient quantity so as to attain a stoichiometry of 0.85 when the amount of close coupled overfire air injected is combined with the amount of air previously injected into the burner region of the furnace; and e. injecting separated overfire air into the burner region of the furnace above and in spaced relation to the point of injection of the close coupled overfire air in a sufficient quantity so as to attain a stoichiometry of approximately 1.0 when the amount of separated overfire air injected is combined with the amount of air previously injected into the burner region of the furnace.

17. The method as set forth in claim 16 further comprising the step of injecting air into the burner region of the furnace below the fuel-rich zone therewithin.

18. The method as set forth in claim 16 further comprising the step of injecting reburn fuel into the burner region of the furnace between the point of injection of the close coupled overfire air and the point of injection of the separated overfire air.

19. The method as set forth in claim 16 further comprising the step of injecting multi-fuels into the burner region of the furnace between the fuel-rich zone therewithin and the additional fuel zone therewithin.

* * * * *